US006099341A

United States Patent [19]

Shymko

[11] Patent Number: 6,099,341

[45] Date of Patent: Aug. 8, 2000

[54] FEMALE RECEPTACLE WITH RETAINING DEVICE FOR SECURING MALE PLUG TO FEMALE RECEPTACLE

[76] Inventor: Wayne W. Shymko, 34 Dvoras Cove, Wpg. Mb., Canada, R2J 4M6

[21] Appl. No.: 09/062,985

[22] Filed: Apr. 21, 1998

[51] Int. Cl.[7] ..... H01R 13/62

[52] U.S. Cl. ..... 439/371; 439/369

[58] Field of Search ..... 439/369, 371, 439/368, 445, 447, 484, 483, 453, 455, 457, 464, 470, 471, 373, 476.1, 654

[56] References Cited

U.S. PATENT DOCUMENTS

| | | | |
|---|---|---|---|
| 1,568,995 | 1/1926 | Benjamin | 439/484 |
| 1,714,763 | 5/1929 | Boyson | 439/484 |
| 2,030,115 | 2/1936 | Muldoon | 439/484 |
| 3,407,377 | 6/1967 | Anderson | 439/456 |
| 4,183,603 | 1/1980 | Donarummo | 439/369 |
| 4,504,106 | 3/1985 | Fechter | 439/297 |
| 4,610,494 | 9/1986 | Schauber | 439/453 |
| 4,664,463 | 5/1987 | Carmo | 439/369 |
| 5,393,243 | 2/1995 | Carmo | 439/369 |
| 5,409,397 | 4/1995 | Karman | 439/484 |

*Primary Examiner*—Paula Bradley
*Assistant Examiner*—Ross N. Gushi
*Attorney, Agent, or Firm*—Donald J. Ersler

[57] ABSTRACT

A female receptacle with retaining device is intended to provide a method of securing a male plug attached to an electrical device power cord to a female receptacle attached to a power supply cord. The electrical device cord with the male plug is positively retained by threading the electrical device cord between a hoop and a body of the female receptacle. The locking action of the electrical device cord threaded through itself will prevent the disconnection of the male plug from the female receptacle and will relieve strain on the male prongs and prevent subsequent damage.

4 Claims, 3 Drawing Sheets

FEMALE RECEPTACLE WITH RETAINING DEVICE FOR SECURING MALE PLUG TO FEMALE RECEPTACLE

BACKGROUND

This invention relates to a female power receptacle with a locking hoop for retaining a male plug attached to a device power cord to prevent them from disconnecting during use.

This device would be desireable for a number of reasons.

Firstly it will prevent male plugs on electrical devices from disconnecting from the female receptacle during usage or strain.

Secondly it will eliminate the strain on the male/female connection preventing damage to the male prongs and possible short circuiting in the connection when strained or pulled.

Thirdly it will eliminate the need to tape or mechanically fasten or bend the male prongs to provide a secure connection between the male plug and female receptacle. To prevent disconnection during use.

SUMMARY OF THE INVENTION

This receptacle is moulded from a suitable material i.e. rubber, PVC, etc. that will withstand the abuse and atmospheric conditions that power cords will be subjected to. The receptacle has the power supply cord moulded or fastened to the receptacle body along with the metal connections that will receive the prongs from the male plug. The body will have a moulded hoop on each side of the body that will allow the user to thread the device cord through. This will provide a positive strain relief that will prevent the male prongs from disconnecting from the female receptacle when strained.

The receptacle can be manufactured in any length with any number of female connections to receive any number of male plugs. The hoops can be any length as required.

GLOSSARY OF TERMS

Figure 1:
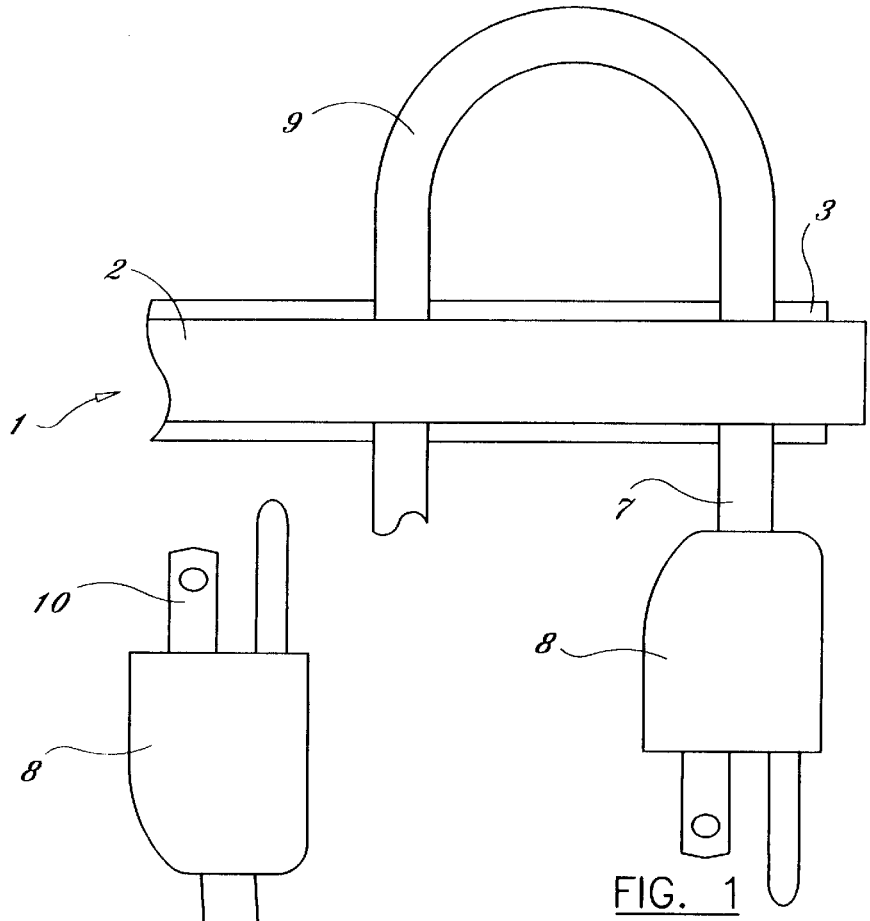
FIGS. 1, 2 and 3 are the threading sequence for locking the device power cord to the female receptacle.

1) Female Receptacle . . . entire device that contains all components

2) Hoop . . . portion of receptacle that allows electrical device cord to form a "knot" around.

3) Body . . . portion of receptacle that contains female power connections for male plug to connect to.

4) Power Supply Cord . . . supplies power to receptacle, terminates in the body at female power connections.

5) Female Power Connections . . . contained in body of receptacle and supplies power to male prongs of device power cord whrn plugged into.

6) Void . . . portion of receptacle formed by the body on one side and hoop on the other. Allows "U" of device cord to pass through.

7) Power Cord . . . electrical device power cord.

8) Male Plug . . . plug attached to power cord contains prongs that receive power from female power connections.

9) "U" Shaped Loop . . . loop formed by device power cord when passed through void. This forms a portion of the knot that will retain the device power cord and male plug.

10) Male Prongs . . . portion of male plug that connects to female power connections and receives power.

DETAILED DESCRIPTION

The female receptacle (1) is moulded in a monolithic form which encapsulates the power supply cord (4) and the metal power connections (5) to receive the male prongs (10).

This receptacle can also be manufactured in a multi piece modular form that can be retrofit to existing power supply cords.

The female receptacle(1) has hoops(2) moulded on either side of the body(3) or entirely around the body(3). The void(6) formed by this configuration allows the device power cord(7) to pass through. The threading of the device power cord(7) locks around the hoop(2) to form a knot and acts as a strain relief. Relieving strain on the male plug(8) and the female power connections(5).

The void (6) distance between the body(3) and the hoop (2) should be determined by the gauge of device power cord(7) that it will be required to lock. This distance is recommended to be approximately equal to the power supply cord(4) thickness.

The thickness of the female receptacle(1) and the hoop(2) will be determined by good manufacturing practices. The female power connections(5) can be provided on either or both sides of the body(3).

The threading operation to obtain the knot around the hoop(2) that provides the locking action is as follows.

Step 1

FIG. 1 a "U" shaped loop(9) is formed and passed between the hoop (2) and body(3) through void(6).

Step 2

Figure 2:
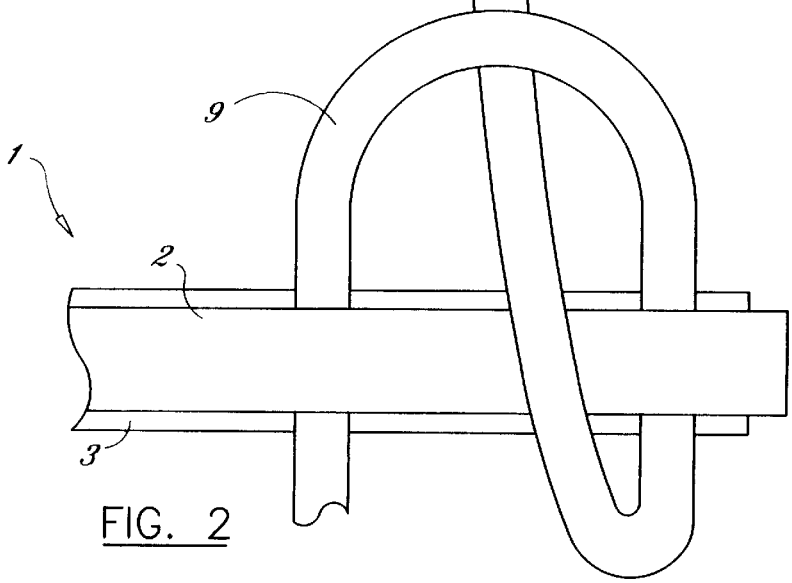
Figure 4:
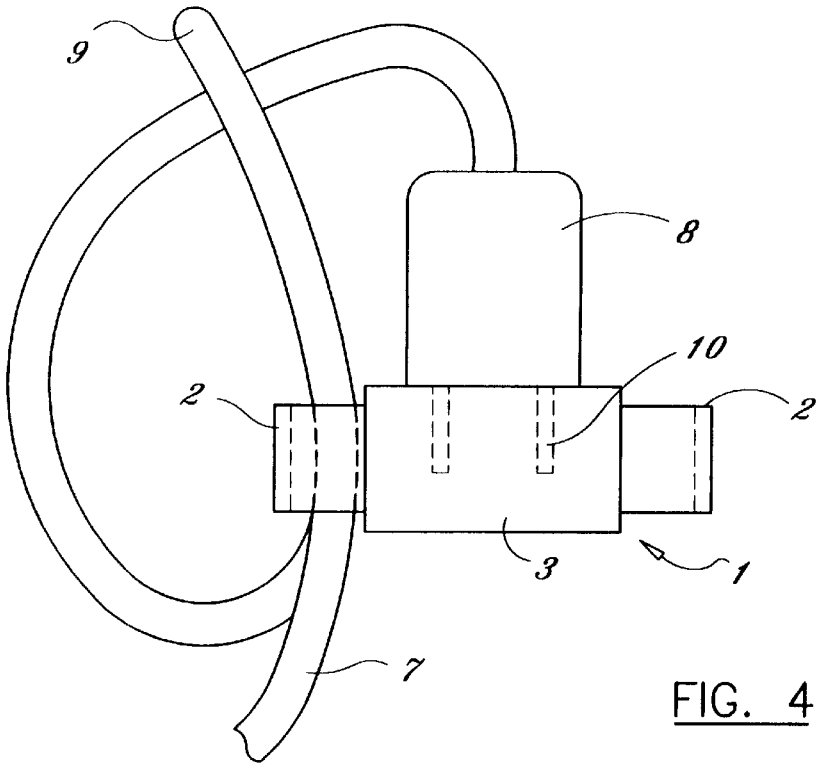
FIG. 4 is a end view of the receptacle showing the final threading arrangement.
Figure 5:
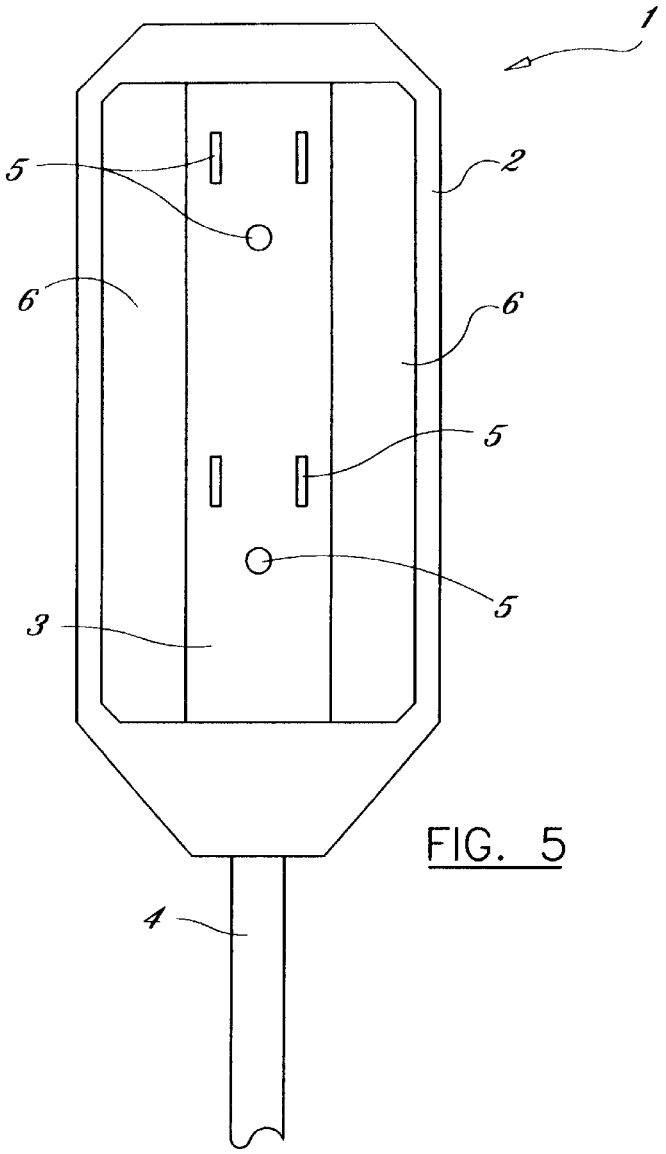
FIG. 5 is a top view of the apparatus.
Figure 6:
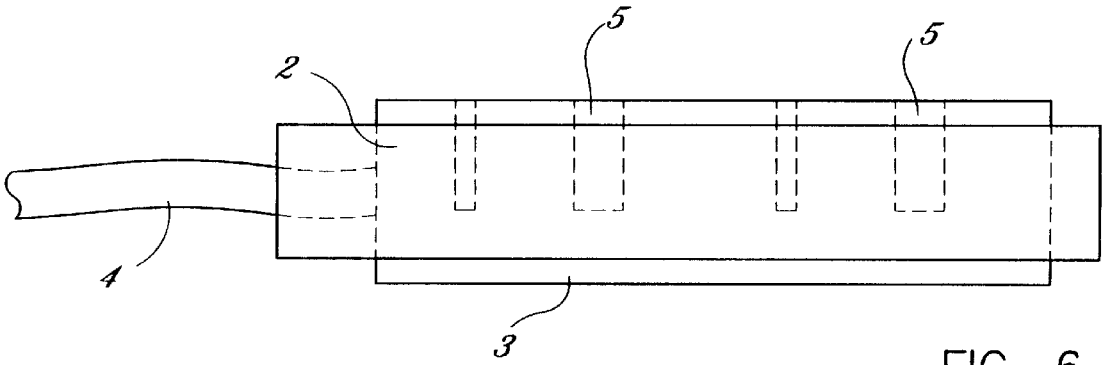
FIG. 6 is a side view of the apparatus.

FIGS. 2 & 4. The male plug(8) is passed underneath the "U" shaped loop(9)

Step 3

Figure 3:
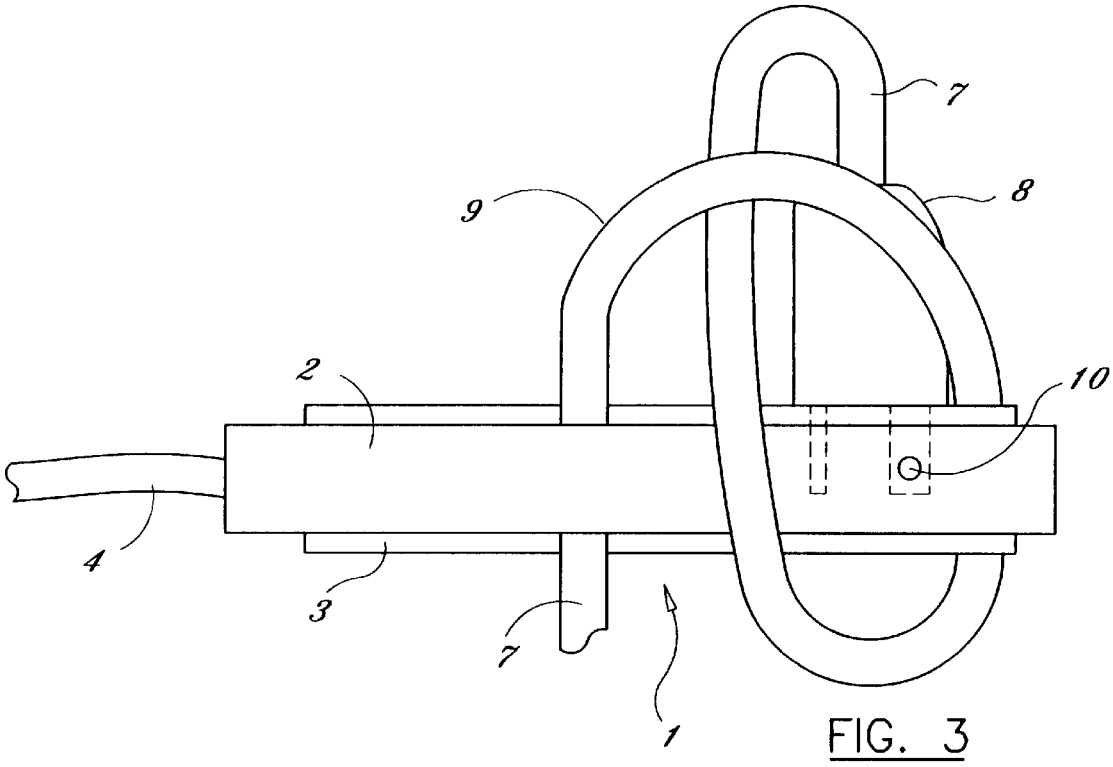

FIG. 3. Male plug(8) is plugged into female power connections(5) in body(3).

This provides a secure strain relief between the male/female connection. The more you pull on the device power cord(7) the tighter the "U" shaped loop(9) will secure the device power cord(7).

To release this connection the steps are reversed.

Various modifications can be made in my invention described above, with different embodiments within the scope claims without departing from the spirit and scope.

It is intended that all matters contained in the accompanying specifications shall be illustrative only and not in a limiting sense.

What is claimed is:

1. A female receptacle with retaining device for securing a male plug to a female power connection, comprising:

a body having a top, bottom, two sides, and two ends, at least one female power connection being disposed in said top of said body at least one hoop extending outward from each end of said body, each said hoop creating a void with one of said sides of said body, said void having two sides terminated by two ends, said void having a width which is sufficient to allow insertion of an electrical power cord with a male plug; and said void having a sufficient length to allow said electrical power cord to be bent in a U-shape and inserted into said void.

2. The female receptacle with retaining device for securing a male plug to a female power connection of claim 1, further comprising:

a sufficient length of said electrical power cord being left between a bottom of said at least one hoop and said male plug to allow insertion of said male plug through said U-shaped cord and into said female receptacle; and said at least one female receptacle being supplied with current from a second electrical power cord.

3. A female receptacle with retaining device for securing a male plug to a female power connection, comprising:

a body having a top, bottom, two sides, and two ends, at least one female power connection being disposed in said top of said body, at least one hoop extending outward from each end of said body, each said hoop creating a void with one of said sides of said body, said void having two sides terminated by two ends, said void having a width which is sufficient to allow insertion of an electrical power cord with a male plug;

said void having a sufficient length to allow said electrical power cord to be bent in a U-shape and inserted into said void, a sufficient length of said electrical power cord being left between a bottom of said at least one hoop and said male plug to allow insertion of said male plug through said U-shaped cord and into said female receptacle; and said at least one female receptacle being supplied with current from an electrical power cord.

4. A female receptacle with retaining device for securing a male plug to a female power connection, comprising:

a body having a top, bottom, two sides, and two ends, at least two female power connections being disposed in said top of said body, two opposing hoops extending outward from each end of said body, each said hoop creating a void with one of said sides of said body, said void having two sides terminated by two ends, each said void having a width which is sufficient to allow insertion of an electrical power cord with a male plug;

each said void having a sufficient length to allow at least two said electrical power cords in series to be bent in a U-shape and inserted into each of said voids, a sufficient length of each said electrical power cord being left between a bottom of either of said hoops and each said male plug to allow insertion of said male plug through said U-shaped cord and into said female receptacle; and said at least one female receptacle being supplied with current from an electrical power cord.

* * * * *